US010036390B2

(12) United States Patent
Høj et al.

(10) Patent No.: US 10,036,390 B2
(45) Date of Patent: Jul. 31, 2018

(54) PUMP UNIT

(71) Applicant: GRUNDFOS HOLDING A/S, Bjerringbro (DK)

(72) Inventors: Finn Mathiesen Høj, Aarhus N (DK); Tom Eklundh Larsen, Ulstrup (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 484 days.

(21) Appl. No.: 14/369,359

(22) PCT Filed: Dec. 14, 2012

(86) PCT No.: PCT/EP2012/075499
§ 371 (c)(1),
(2) Date: Jun. 27, 2014

(87) PCT Pub. No.: WO2013/098092
PCT Pub. Date: Jul. 4, 2013

(65) Prior Publication Data

US 2014/0377105 A1 Dec. 25, 2014

(30) Foreign Application Priority Data

Dec. 27, 2011 (EP) ..... 11195805

(51) Int. Cl.
*F04D 13/06* (2006.01)
*F04D 29/08* (2006.01)

(52) U.S. Cl.
CPC ..... *F04D 13/0626* (2013.01); *F04D 13/0606* (2013.01); *F04D 29/086* (2013.01)

(58) Field of Classification Search
CPC ..... F04D 13/0606; F04D 13/0613; F04D 13/0635; F04D 13/0626; F16J 15/34606; F16J 15/062; F16J 15/068; F16C 35/02
See application file for complete search history.

(56) References Cited

U.S. PATENT DOCUMENTS 2,108,265 A * 2/1938 Stoddard ..... F16L 21/04 285/305
3,256,829 A * 6/1966 Schneider ..... H02K 5/128 310/43
4,465,437 A 8/1984 Jensen et al.
(Continued)

FOREIGN PATENT DOCUMENTS

DE 21 00 345 A1 8/1972
DE 2100345 A1 * 8/1972 ..... F04D 13/0613
DE 24 60 748 A1 7/1976
(Continued)

*Primary Examiner* — Kenneth J Hansen
(74) *Attorney, Agent, or Firm* — McGlew and Tuttle, P.C.

(57) ABSTRACT

A pump assembly includes a pump housing (2) and a stator housing (16), which is connected to the pump housing (2) and in which a wet-running electric motor with a can (18, 18') is arranged. A plate-like bearing carrier (26, 26') of sheet-material is arranged between the pump housing and the stator housing (16). The bearing carrier (26, 26') includes a centering surface (40, 40') in a manner distanced to its free peripheral edge, said centering surface coming into bearing contact on a corresponding contact surface (42) of the pump housing (2) in a manner such that the bearing carrier (26, 26') with the can (18, 18') is centered relative to the pump housing (2).

21 Claims, 4 Drawing Sheets

(56) References Cited

U.S. PATENT DOCUMENTS 6,280,156 B1 * 8/2001 Wirz ..... F04D 29/0465
417/420

FOREIGN PATENT DOCUMENTS

| | | | | | |
|---|---|---|---|---|---|
| DE | 26 39 541 | A1 | | 3/1978 | |
| DE | 33 38 507 | A1 | | 11/1984 | |
| DE | 44 41 378 | A1 | | 5/1996 | |
| DE | 197 48 866 | A1 | | 6/1998 | |
| GB | 2 121 240 | A | | 12/1983 | |
| GB | 2121240 | A | * | 12/1983 | ..... F04D 13/0613 |

* cited by examiner

PUMP UNIT

CROSS REFERENCE TO RELATED APPLICATIONS

This application is a United States National Phase Application of International Application PCT/EP2012/075499 filed Dec. 14, 2012 and claims the benefit of priority under 35 U.S.C. § 119 of European Patent Application EP 11 195 805.4 filed Dec. 27, 2011, the entire contents of which are incorporated herein by reference.

FIELD OF THE INVENTION

The invention relates to a pump assembly with a pump housing and with a stator housing, which is connected to the pump housing, and in which a wet-running electric motor with a can is arranged, wherein a plate-like bearing carrier of sheet-material is arranged between the pump housing and the stator housing.

BACKGROUND OF THE INVENTION

For example, pump assemblies which comprise a wet-running electric motor, in which a can separating the rotor space from the dry stator space is arranged, are applied as circulation pumps in heating installations. As a rule, these pump assemblies are designed such that there is a stator housing, in which the stator with the can is arranged, and a pump housing, in which an impeller rotates. The stator housing, and the pump housing, are connected to one another, for example screwed to one another. The impeller is arranged on a rotor shaft of a rotor which is rotatably mounted in the stator or in the can. If the pump housing and the stator housing are connected to one another, it is necessary to center the stator with the impeller in the inside of the pump housing, so that the impeller is arranged in the pump space of the pump housing in a defined manner.

SUMMARY OF THE INVENTION

It is an object of the invention to provide a pump assembly with a pump housing and with a stator housing, which permits the motor components which are arranged in the inside of the stator housing, to be centered relative to the pump housing in a simple manner.

According to the invention, a pump assembly is provided with a pump housing and with a stator housing which is connected to the pump housing. A wet-running electric motor with a can is arranged in the stator housing. A plate-like bearing carrier of sheet-material is arranged between the pump housing and the stator housing. The bearing carrier comprises a centering surface in a manner distanced to (spaced apart from) a free peripheral edge. The centering surface comes into bearing contact on a corresponding contact surface of the pump housing in a manner such that the bearing carrier with the can is centered relative to the pump housing.

The pump assembly according to the invention may for example be a circulation pump assembly, such as a heating circulation pump assembly, and in the known manner may comprise a pump housing as well as a stator housing which are connected to one another. The pump housing and the stator housing may for example be screwed to one another. At least one impeller is arranged in the pump housing, wherein the pump housing defines the flow channels surrounding the impeller. An electric drive motor is arranged in the stator housing and drives the impeller in a rotating manner. Thereby, this electric drive motor is designed as a wet-running electric motor, which means it comprises a can which separates a rotor space, in which the rotor with the rotor shaft rotates, from the surrounding stator space. The rotor space is filled with the fluid to be delivered, whilst the stator space, in which electrical components such as coils are arranged, is dry.

The rotor in the inside of the stator housing is rotatably mounted. For this, at least one bearing, in particular a thrust bearing is provided, which is fastened on a bearing carrier which is situated between the pump housing and the stator housing. This means that the bearing carrier lies in the region of the interface between the pump housing and the stator housing. According to the invention, the bearing carrier is formed from sheet metal and carries a bearing which may be a thrust bearing and/or a radial bearing.

According to the invention, the bearing carrier, distanced to its free peripheral edge, comprises a centering surface which comes into bearing contact on a corresponding contact surface of the pump housing in a manner such that the bearing carrier with the can is centered relative to the pump housing. For this, the can is preferably connected to the bearing carrier, so that the can with the rotor arranged therein is centered relative to the pump housing via the bearing carrier. The assembly is simplified by way of this, since all components, specifically the can, rotor and pump housing may simultaneously be centered to one another via the bearing carrier. Preferably, at least one further radial bearing for the rotor is arranged on or in the can, so that the rotor is centered with respect to the can, and the can then, due to its fastening on the bearing carrier, may then be centered together with the rotor relative to the pump housing, via the bearing carrier.

Due to the fact that a centering surface distanced to the free peripheral edge is used for centering the bearing carrier, it is more simply possible to design this centering surface concentrically to the middle axis. Thus, one may make do without machining the free peripheral edge of the bearing carrier in a material-removing manner, in order to design this in a centric manner.

Preferably, the centering surface is distanced to the free peripheral edge in the radial and/or axial direction. With a radial distancing, the centering surface lies radially further inwards than the free peripheral edge of the bearing carrier formed from sheet metal. An axial distancing may be achieved by way of the bearing carrier in the region of its outer periphery for example having an axially directed peripheral wall or an axially directed collar, on which the centering surface is designed distanced to the free edge.

The contact surface in the pump housing is preferably an inner peripheral surface which is designed in an annulus-shaped manner and in a manner arranged centrically to a rotation axis of an impeller arranged in the pump housing. Due to the bearing contact of the centering surface of the bearing carrier, this is thus centered to the desired rotation axis of the impeller in the pump housing.

The centering surface is preferably designed as an annular peripheral surface or from several individual surfaces which are distributed over the periphery distanced to one another. This means that the bearing carrier with its centering surface does not have to bear on the contact surface of the pump housing over the whole periphery, but rather it may bear only in individual surface regions which are distributed over the periphery and are formed by individual surfaces.

Particularly preferably, the centering surface is designed by way of forming (non-cutting shaping) the sheet metal centrically to the middle point of the bearing carrier. This simplifies the manufacture, since one may make do without a material-removing machining of the centering surface and this may be created alone by way of the forming machining of the sheet metal. For this design, it is particularly advantageous if the centering surface is distanced to the free peripheral edge of the bearing carrier. The centering surface is thus situated in a region of the bearing carrier which may be favourably machined in a forming manner. The centering of the centering surface to the middle point of the bearing carrier means that the centering surface is centered to the middle point of a bearing for the rotor, said bearing to be accommodated. The bearing carrier comprises a suitable receiver for the bearing and this receiver for its part is preferably arranged centrically to the middle point of the bearing. Alternatively, the bearing after insertion into the receiver may be concentrically ground relative to the centering surface.

As described above, the bearing carrier is preferably connected to the can. In particular, the bearing carrier may be fastened on the can with a non-positive and/or positive fit. Thus, the can together with the bearing carrier may be attached and fixed on the pump housing. According to a particular embodiment, the bearing carrier may simultaneously form part of a can or can pot, if it is connected to the can in a sealed manner. Thus, the bearing carrier could simultaneously seal the stator space on its axial side, to the pump housing, so that in this region one may make do without an additional radial collar of the can or of the can pot.

According to a further embodiment, the bearing carrier comprises an axially extending collar ring which preferably engages around the can. Thus, via this collar ring, one may create a bearing contact of the bearing carrier on the can for connection between the bearing carrier and the can. Here, a non-positive connection between the collar ring and the can may be achieved via suitable fits. A positive engagement may also be achieved with a suitable shaping.

Preferably, the can at its axial end which faces the pump housing comprises a radially extending collar which on its outer periphery comprises an axially extending peripheral wall around which the collar ring of the bearing carrier engages, on the outer periphery. The radially extending collar of the can preferably serves for closing and sealing the stator space at its axial side facing the pump housing, with respect to the pump housing. This means that according to the invention, the can does not necessarily need to have an exclusively circular-cylindrical shape, but at an axial end may have the described radially extending collar. The can may be designed in a closed manner at the axial end which is away from the pump housing, in order to form a can pot. Thereby, the closed axial end which means the end which is away from the pump housing may also be closed by way of a removable plug, in order to be able to open the can at this location.

If the collar ring of the bearing carrier engages around an axially extending peripheral wall on the outer periphery of the radially extending collar of the can, this means that the bearing carrier and the collar of the can extend in a section in a manner lying over one another transversely to the rotation axis of the rotor, wherein the bearing carrier and the collar do not necessarily need to extend parallel to one another. The radial collar of the can assumes the described sealing function, whilst the bearing carrier transmits the forces acting on the bearing, onto the pump housing.

The peripheral wall on the outer periphery of the radially extending collar of the can further preferably on its outer periphery is designed in a centered manner with respect to the middle axis of the can. For this, the outer periphery of the peripheral wall may be machined in particular in a material-removing manner, for example by turning or grinding, for the centering. In particular, this peripheral wall is centered with respect to the bearing surfaces of a radial bearing for the rotor shaft, said radial bearing being arranged in the inside of the can or fastened on the can. The bearing carrier which engages over or encompasses this peripheral wall with its collar ring, for fastening the bearing carrier, is likewise centered with respect to the rotation axis via this peripheral wall. If then the bearing carrier is centered via a centering surface in the pump housing, then simultaneously the can is also centered with respect to the pump housing.

The fit between the peripheral wall on the outer periphery of the radially extending collar of the can, and the engaging-over or encompassing collar ring of the bearing carrier is preferably designed in at least two tolerance regions over its axial length. Thus the fit preferably to the axial end facing the impeller has more play, so that when putting the bearing carrier onto the can, this bearing carrier may firstly be pushed more easily on and with a further axial movement is clamped in a firm manner. Thus, a straight and precise placing of the bearing carrier onto the peripheral wall on the collar of the can is simplified.

The collar ring on its inner periphery may comprise preferably radially inwardly directed clamping projections which bear on the can in a clamping manner. The clamping projections may particularly preferably be formed by at least one radially inwardly directed bend-out of the collar ring. Such a bend-out may be created by way of a purely forming machining of the sheet metal component, from which the bearing carrier is manufactured. Particularly preferably, the bend-out may be designed in an annular manner and thus extend over the whole periphery of the collar ring.

As described above, the bearing carrier in an alternative embodiment may simultaneously assume the function of the radially extending collar of the can, and seal the stator space at its axial side which faces the pump housing. For this, the bearing carrier may be designed in an annular manner and in the region of its inner periphery may be sealingly connected to an axial end of the can, for example welded to the can.

According to a further preferred embodiment, the bearing carrier comprises an axially extending collar ring, and the centering surface is formed on the outer periphery of this collar ring. Thereby, the collar ring is likewise arranged in the region of the outer periphery of the bearing carrier. The collar ring may be produced by way of a forming machining of the sheet metal, from which the bearing carrier is manufactured. As described above, the centering surface may then likewise be created easily alone by way of forming machining, on the collar ring on the outer periphery, so that one may make do without a material-removing machining such as turning or grinding.

The centering surface is preferably formed on at least one radially outwardly directed bend-out of the collar ring. The bend-out or bulge may thereby extend over the whole periphery of the collar ring or only in individual peripheral sections distributed over the periphery, in order to form the centering surface. These peripheral sections then form the individual surfaces described above, which serve for centering the pump housing. The centering surface is situated on the radially outwardly directed bend-out or bulge, preferably in the apex region of this bend-out.

Further preferably, a contact region, with which the bearing carrier bears on the can, is distanced in the axial direction to the centering surface on the bearing carrier. The bearing carrier is centered relative to the can via the contact region. Due to the fact that the centering surface is designed distanced to the contact region in the axial direction, these may be designed in a centric manner independently of one another. In particular, the design of the centering surface and of the contact region may be effected concentrically to one another, independently of the sheet metal thickness.

Particularly preferably, the bearing carrier comprises an axially extending collar ring which in at least one peripheral section has a cross-section shaped in an s-like manner. Thereby, the cross section shaped in an s-like manner has an outwardly directed bend-out and an inwardly directed bend-out. The inwardly directed bend-out forms the contact region or the clamping projection for fixing the bearing carrier on the can. The outwardly directed bend-out of the s-shaped cross section preferably forms the centering surface as has been described previously. The s-like shape may for example an s-shaped or z-shaped shape or one formed in a similar manner, with a radially inwards bend-out and a radially outwards bend-out. If the bend-outs do not extend around the complete periphery but only in individual peripheral sections, for example designed in a point-like manner, moreover the radially outwardly directed bend-out and the radially inwardly directed bend-out do not need to lie at the same angle. With such a design, there is no cross section shaped in an s-like manner in the actual sense, but however with such a design then as a whole however an essentially s-like shaped cross section may be present in a projection in the peripheral direction.

Thus simultaneously, the centering to the can and to the pump housing is achieved via this s-shaped cross section. Thereby, this s-shaped cross section may be formed alone by way of the forming machining of the bearing carrier, wherein simultaneously two centering surfaces, specifically the inwardly directed contact surface for the can and the outwardly directed centering surface for the bearing contact in the pump housing is created.

The collar ring usefully at its free end comprises an axial surface extending transversely to the middle axis. This axial surface thus preferably extends in the radial direction and projects preferably outwards from the collar ring in the radial direction. Such an axial surface may be produced by bending the collar ring at its free end. The axial surface forms a press surface, on which a pressure for deforming the collar ring may be exerted, in order to produce radially inward and/or radially outward bend-outs, in order to create the previously described centering surfaces and contact surfaces for the bearing contact and centering on the pump housing or for the bearing contact on the can. In particular, by way of axial compression of the collar ring, one may produce an s-shaped cross section, as has been described previously. The s-shaped cross section may extend preferably over the whole periphery of the collar ring. However, it is also possible for such a cross section to be formed only in individual peripheral regions, and specifically in those peripheral regions, in which individual surfaces for the centering surfaces and clamping projections of or contact regions for bearing contact on the can are formed.

According to a further preferred embodiment of the invention, an end-side surface of the bearing carrier may have a surface section which is toroidally convexly curved towards the pump housing. This means that this surface section is annular and in a cross section seen in the radial direction is curved convexly towards the pump housing. Thus, an annular bend-out in the end-side surface towards the pump housing is created. This shape of the otherwise plate-like or disk-like bearing carrier is advantageous in many aspects. In the case that the bearing carrier simultaneously serves for sealing the stator space, which is to say that it is dry on its rear side which is away from the pump housing, this shape has the advantage that it may better resist the pressure prevailing in the pump housing, so that an undesired deformation of the bearing carrier does not occur due to the fluid pressure prevailing in the pump housing. A deformation of the bearing carrier is undesirable, since such could lead to faulty positions of the bearing and in the worst case could lead to a blocking of the pump. This means that the toroidally convexly curved shape of the bearing carrier ensures a greater stability of the bearing carrier and thus ensures a more stable and deformation-free mounting of the bearing on the bearing carrier.

Moreover, the surface of the bearing carrier by way of the toroidally convexly curved shape of the annular surface section may be brought closer to the impeller and thus contribute to the definition of the flow path surrounding the impeller in the pump housing.

The end-side surface further preferably on its outer periphery comprises an annular, surface section which extends transversely to the middle axis and on which the previously described curved surface section connects in a radially inwardly lying manner. The annular surface section which extends transversely to the middle axis and which extends in particularly radially at a right angle to the middle axis or rotation axis of the rotor, likewise just as the above-described axial surface extending transversely to the middle axis, at the opposite free end of the collar ring, serves for the deformation of the collar ring for forming the centering surface and the contact region for bearing contact on the can which should likewise be designed in a centered manner. Thus, a pressure force may be applied between the axial surface at the free end of the collar ring and the described annular surface section extending transversely to the middle axis, and this pressure force compresses the collar ring in the axial direction, so that radially outwardly directed and/or radially inwardly directed bulges occur, in particular such that the previously described s-shaped cross-sectional shape occurs. In this manner, the centering surface may be formed at the apex of a radially outwardly directed bulge and a centered contact surface or a centered clamping projection for bearing contact on the can may be formed in the apex region of an inwardly directed bulge.

The toroidally convexly curved surface section has an annular, plane apex region. This plane apex region preferably likewise extends transversely to the middle or rotation axis. Thereby, in particular, it extends normally to this rotation axis or in a slightly angled manner, which means at an angle of preferably smaller than 45 degrees to a cross-section plane or diameter plane relative to the middle axis or rotation axis.

The apex region of the curved surface section may preferably cover a spiral channel in the pump housing, at least in a pressure-side section. Thus, this surface section serves for leading the flow at a spiral channel peripherally surrounding the impeller, in particular in a pressure-side section of the spiral channel.

According to a further particular embodiment, a region of the curved surface section which is situated radially outside the apex, may have a smaller gradient than a region of the curved surface section which lies radially inwardly of the apex. In particular, with this embodiment, the plane apex region may reach up to the periphery of a bearing receiver in the bearing carrier, in which receiver the bearing is held. This means that here the apex region lies essentially adjacent the inner periphery of the annular bearing carrier, in a manner surrounding the bearing receiver.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
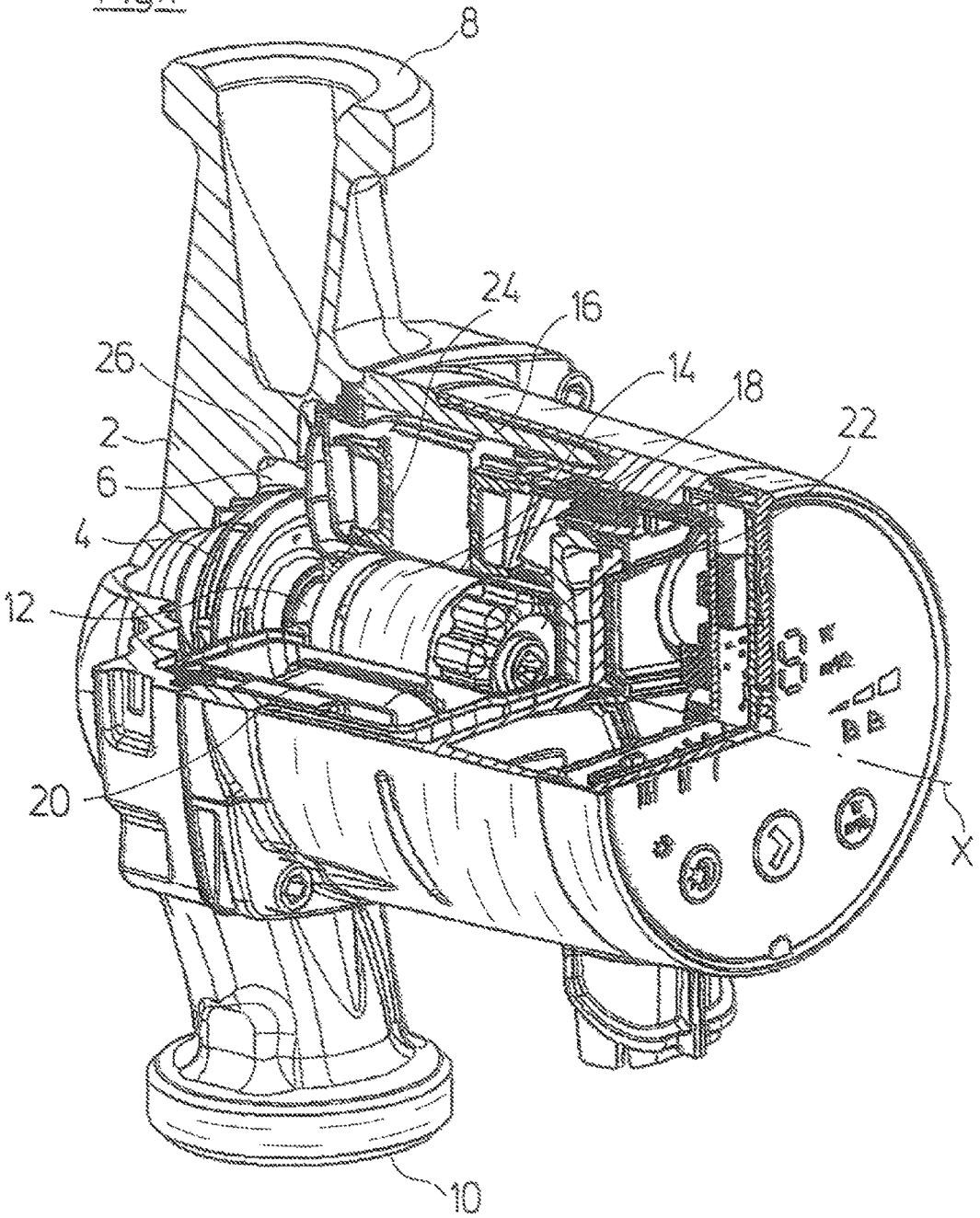
FIG. 1 is a partly sectioned total view of a pump assembly according to the invention.

Referring to the drawings in particular, the pump assembly according to the invention comprises a pump housing 2, in whose inside an impeller 4 is arranged. A free space is formed in the pump housing 2 in a manner surrounding the impeller 4, and this free space defines a spiral channel 6 which runs out into a pressure connection 8. The pump housing 2 at the side which is opposite the pressure connection 8 comprises a suction connection 10 which has a flow channel running out into the suction port of the impeller 4.

The impeller 4 is connected via the rotor shaft 12 to a rotor 14 in a rotationally fixed manner.

The rotor 14 is part of an electric drive motor which is arranged in the inside of a stator housing 16 and which is screwed to the pump housing 2. The electric motor is designed as a wet-running motor and comprises a can pot 18 which separates a dry annular space, in which the stator 20 is arranged, from the wet rotor space, in which the rotor 14 rotates. The rotor space in the inside of the can pot 18 is filled with the fluid to be delivered.

The rotor 14 is mounted in two bearings 22 and 24, wherein the bearing 22 is held in the inside of the can pot 18 at the end which is away from the impeller 4. The bearing 22 is designed as a radial bearing, whilst the bearing 24 is designed as a radial and axial bearing. The bearing 24 is held in a bearing carrier 26.

The bearing carrier 26 is designed as a shaped part (shaped in a non-cutting manner) of sheet metal. The bearing carrier 26 has an annular shape and thereby is toroidally convex to the pump housing 2, which is to say is curved towards the impeller 4. On the inner periphery, the bearing carrier 26 comprises a receiver 28 in the form of a hole, in which the bearing 24 is held. The bearing 24 is fixed in the receiver 28 preferably with a non-positive fit. With regard to the bearing 24 it is the case of a ceramic plain bearing.

On its outer periphery, the bearing carrier 26 comprises an annularly, essentially axially extending collar ring 30. The can pot 28 at its open axial end which faces the pump housing 2 comprises an essentially radially extending collar 32 which closes the annular stator space on the axial side to the pump housing 2.

The collar 32 on its outer periphery comprises an axial directed peripheral wall 34 which extends from the collar 32 in the axial direction away from the pump housing 2. The collar ring 30 engages around the peripheral wall 34 in a peripheral manner. Thereby, the collar ring 30 is fixed on the outer periphery of the peripheral wall 34 with a non-positive fit. Thus, the bearing carrier 26 is fixed on the can pot 18. The region of the connection between the can pot 18 and the bearing carrier 26 is described in more detail by way of the detail enlargement of FIG. 3.

The peripheral wall 34 has an outer peripheral surface which is machined in a material-removing manner. The outer peripheral surface of the peripheral wall 34 is machined such that it is centered with respect to the longitudinal axis or rotation axis X of the rotor 14. This means that the outer surface of the peripheral wall 34 extends concentrically to a bearing surface in the bearing 22 and to the peripheral wall of the can pot 18 in the region surrounding the rotor 14. Thus, the outer peripheral surface of the peripheral wall 34 forms a centered peripheral surface, on which for its part the bearing carrier 26 may be centered. The bearing carrier 26 for this comprises clamping surfaces or clamping projections 36 which are formed on the inner periphery of the collar ring 30. These clamping projections 36 are arranged concentrically to the bearing surface of the bearing 24. If thus the bearing carrier 26 is centered on the outer peripheral surface of the peripheral wall 34, then simultaneously the bearing 24 in the bearing carrier 26 is centered with respect to the longitudinal axis X and is aligned flush to the bearing 22. The clamping projections 36 have such a large contact surface that a tilting or jamming of the bearing carrier 26 is avoided.

The collar ring 30 moreover, in a manner axially distanced to the clamping projections 36, comprises a radially outwardly directed bulge 38 which on its outer peripheral surface forms a centering surface 40. The centering surface 40 is shaped or calibrated such that it is likewise centered with respect to the middle axis and or longitudinal axis of the bearing 24 and thus the longitudinal axis or rotation axis X of the rotor. The centering surface 40 comes to bear on a contact surface 42 which is formed on the inner periphery of the pump housing 2. By way of this, the bearing carrier 26 is centered in the inside of the pump housing 2. Due to the fact that the can pot 18 for its part is fastened on the bearing carrier 26 in a centered manner, thus the can pot 18 with the bearing 22 arranged therein and with the rotor 14 is also centered with respect to the pump housing 2 via the bearing carrier 26 and its centering surface 40. Thus, the complete stator with the stator housing, the can pot 18, the rotor 14, the bearing carrier 26 and the impeller 4 may be preassembled and subsequently inserted into the pump housing 2 in a centered manner.

What is essential to the invention is the fact that the centering surface 40 is distanced axially as well as radially from the free peripheral edge 44 of the bearing carrier 26 formed from sheet metal. This permits the centering surface 40 to be manufactured alone by way of forming, and permits it to be calibrated. For this purpose, an axial surface 46 extending essentially transversely to the longitudinal axis X is formed on the free peripheral edge 44 by way of bending away to the outside. An annular surface section 48 which extends normally to the middle axis or rotation axis and which forms a part of the end-side surface of the bearing carrier 26 connects at the opposite axial end of the collar ring 30, peripherally inwards of the collar ring 30. The collar ring 30 may be compressed via pressure on the axial surface 46 and the surface section 48, so that the radially inwardly bulged or bent-out clamping projections 36 and simultaneously a radially outwardly directed bend-out or bulge 38 is created, which in its apex region forms the centering surface 40. In this manner, an essentially s-shaped cross section of the collar ring 30 is created. Thus, by way of an axial compression of the collar ring 36 in an annular gap of a tool, thus simultaneously the radially inner lying contact surfaces defined by the clamping projections 36, as well as the centering surface 40 situated on the outer periphery, may be centered and formed out in a defined manner. A material-removing machining for centering is thus not necessary.

The axial surface 46 moreover has the advantage that an annular seal 50 may be held between the axial surface 46 and a radially outwardly directed projection of the peripheral wall 34, and this seal seals the stator housing 16 with respect to the pump housing 2 and the can pot 16 with respect to the pump housing 2.

Figure 2:
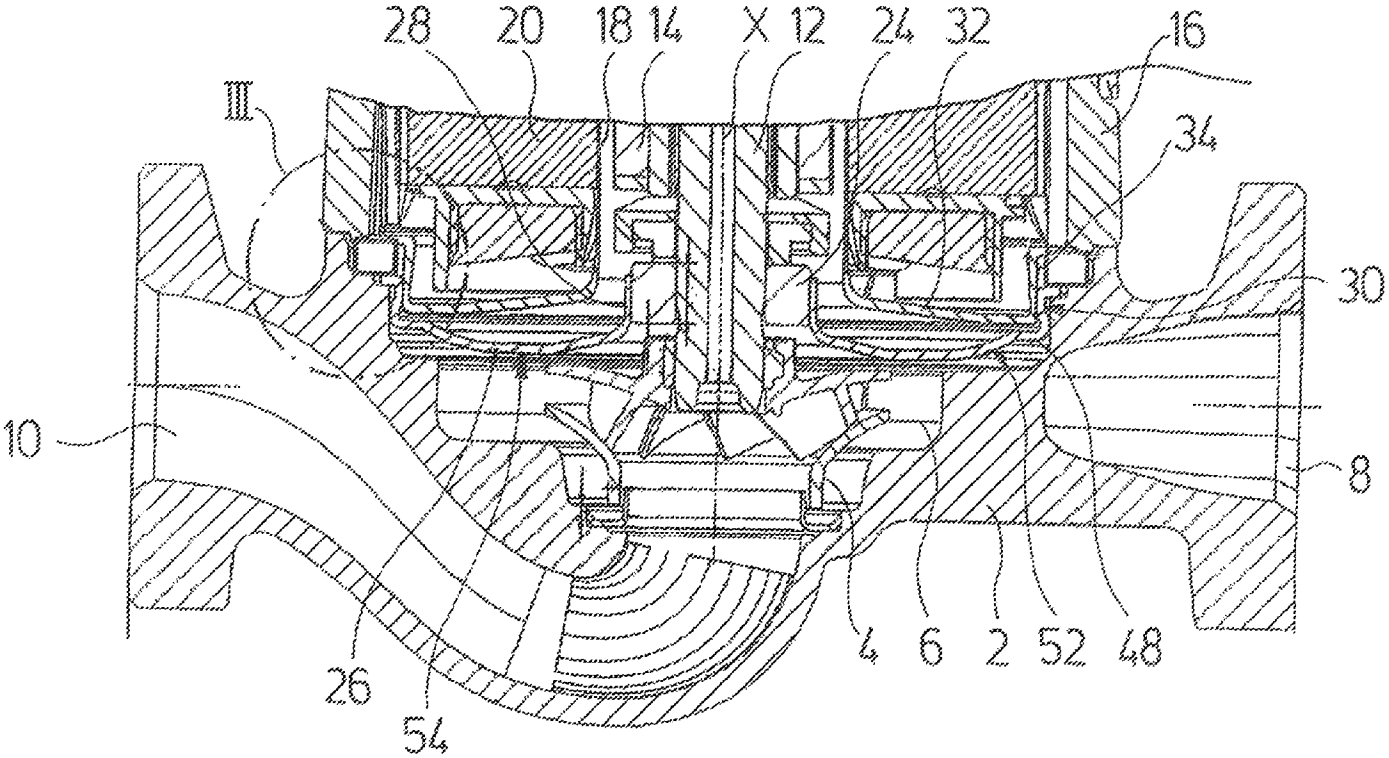
FIG. 2 is a sectioned view through the interface between the pump housing and the stator housing of the pump assembly according to FIG. 1.

As is to be seen in FIG. 2, the toroidally convexly curved surface section 52, departing from the surface section 48, extends radially inwards up to the receiver 28 for the bearing 24. The thus formed bulge of the surface section 52 towards the inside of the pump housing 2 ensures a greater stability of the bearing carrier 26 formed from sheet metal, which contributes to the bearing being held in a defined position even with a high pressure in the inside of the pump housing 2.

The apex region 54 of the toroidally convexly curved surface section extends essentially transversely or normally to the longitudinal axis X and thus forms an annular surface. This region on the pressure side covers the spiral channel 6 and thus serves for leading the flow at the exit side of the impeller 4. This apex region 54 is situated closer to the spiral channel 6 and to the impeller 4 due to the bulging of the surface section 52, so that the gap between the bearing carrier 26 and the walls of the pump housing 2 adjacent the spiral channel 6 is reduced in size. In this manner, flow losses in the inside of the pump housing 2 can be minimized. Moreover, it permits the region of the pump housing 2 which defines the spiral channel 6 to be formed without undercuts, so that this region may be axially without a core when casting the pump housing 2.

With the example shown in FIG. 2, the apex region 54 of the surface section 52 lies roughly in the radial middle of the surface section 52, and the radially inner lying section which extends towards the receiver 28 has roughly the same gradient as the radially outer lying region which extends towards the surface section 48.

Figure 3:
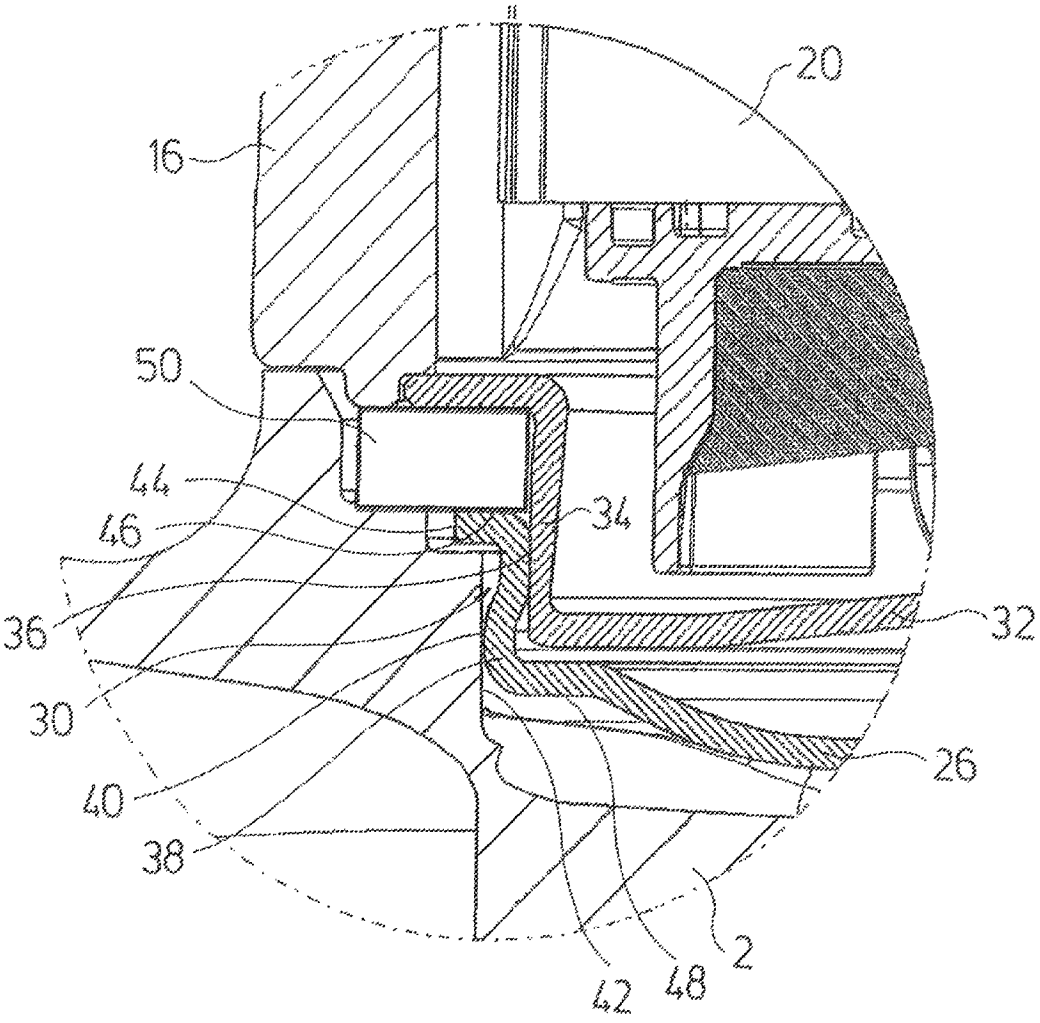
FIG. 3 is an enlargement of the detail III in FIG. 2.
Figure 4:
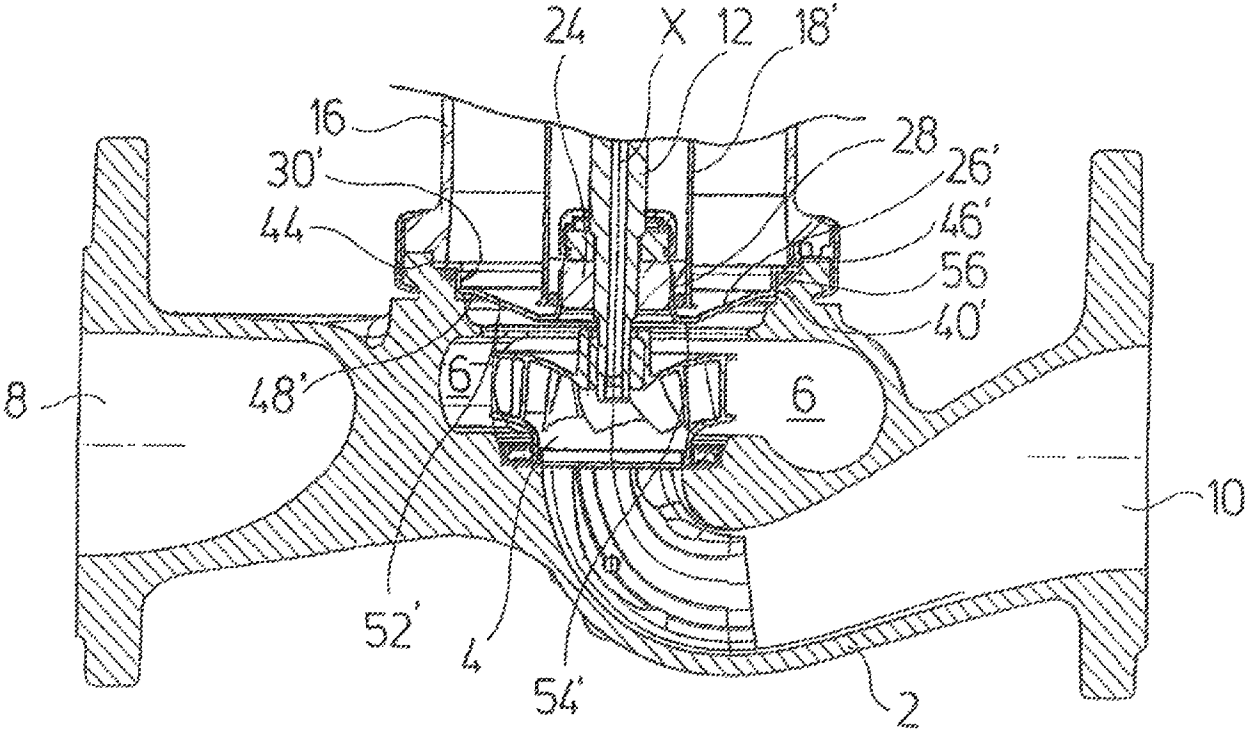
FIG. 4 is a sectioned view through the interface between the pump housing and the stator housing of a pump assembly, according to a second embodiment of the invention.

With the second embodiment example which is shown in FIG. 4, the bearing carrier 26' is designed in a different manner. With the embodiment shown in FIG. 4, the bearing carrier 26' which is likewise manufactured as a sheet metal component, is part of a can pot and for this is sealingly connected to the can 18'. The bearing carrier 26' thus seals the annular stator space in the inside of the stator housing 16 axially with respect to the interior of the pump housing 2. This means that the bearing carrier 26' here is dry at its rear side which is away from the pump housing 2, whilst the bearing carrier 26 with the previous first embodiment examples described by way of FIGS. 1 to 3 comes into contact with the fluid to be delivered on both sides, which means is wet on both sides. With the embodiment example according to FIG. 4, a greater pressure acts on the bearing carrier 26' from the side which faces the pump housing 2 than from the rear side which faces the stator housing 16 and at which essentially atmospheric pressure prevails. In order despite this to prevent a deformation of the bearing carrier 26' with this embodiment example, the apex region 54' is arranged lying radially further inwards essentially directly adjacent the receiver 28 for the bearing 24. Moreover, this apex region 54' is designed in a narrower manner. The curved or here inclined surface section 52' extends lying radially outside the apex region 54 up to the annular surface section 48'. This means that here the surface section 52' which is curved or formed out convexly towards the pump housing 2 is designed more in a cone-shaped manner and extends up to the central region of the bearing carrier 26' which surrounds the receiver 28. Thus an even greater stability is achieved.

The centering surface 40' on the outer periphery of the collar ring 30' is designed according to the first embodiment described by way of FIGS. 1 to 3. Here, the inner periphery of the collar ring 30 does not serve only for fixation on the can 18'. For sealing the bearing carrier 26' with respect to the pump housing 2, a sealing ring 56 is arranged between the radially projecting sections of the collar ring 30' which defines the axial surface 46', and the pump housing 2.

While specific embodiments of the invention have been shown and described in detail to illustrate the application of the principles of the invention, it will be understood that the invention may be embodied otherwise without departing from such principles.

The invention claimed is:

1. A pump assembly comprising:

a pump housing;

a stator housing connected to the pump housing;

a wet-running electric motor with a can arranged in the stator housing;

a bearing carrier of sheet-material arranged between the pump housing and the stator housing, the bearing carrier comprising a centering surface spaced apart from a free peripheral edge, said centering surface coming into bearing contact on a corresponding contact surface of the pump housing in a manner such that the bearing carrier with the can is centered relative to the pump housing, wherein the bearing carrier comprises an axially extending collar ring and the centering surface is formed on the outer periphery of the collar ring on at least one radial outwardly directed bend-out of the collar ring; and a sealing element, the sealing element comprising a first surface and a second surface, the first surface being located opposite the second surface, the first surface and the second surface extending in a radial direction with respect to a longitudinal axis of the stator housing, the bearing carrier comprising a bearing carrier sealing element contact surface, the can comprising a can sealing element contact surface, the bearing carrier sealing element contact surface and the can sealing element contact surface extending in the radial direction with respect to the longitudinal axis of the stator housing, the can sealing element contact surface being in direct contact with the first surface, the bearing carrier sealing element contact surface being in direct contact with the second surface, the can sealing element contact surface being located opposite the bearing carrier sealing element contact surface.

2. A pump assembly according to claim 1, wherein the centering surface is located ring, on the radial outwardly directed bend-out in an apex region of the radial outwardly directed bend-out.

3. A pump assembly according to claim 1, wherein the centering surface is distanced to the free peripheral edge in at least one of a radial direction and an axial direction.

4. A pump assembly according to claim 1, wherein the contact surface in the pump housing is an inner peripheral surface which is designed in an annulus-shaped manner and centrically to a rotation axis of an impeller arranged in the pump housing.

5. A pump assembly according to claim 1, wherein the centering surface is designed as an annular peripheral surface or is formed by several individual surfaces which are distanced to one another and distributed over the periphery.

6. A pump assembly according to claim 1, wherein the centering surface is designed by way of forming a sheet metal part centrically to a middle point of the bearing carrier.

7. A pump assembly according to claim 1, wherein the bearing carrier is fastened on the can with at least one of a non-positive fit and a positive fit.

8. A pump assembly according to claim 1, wherein the axially extending collar ring engages around the can.

9. A pump assembly according to claim 8, wherein the can at an axial end which faces the pump housing comprises a radially extending collar which on an outer periphery comprises an axially extending peripheral wall, around which the collar ring of the bearing carrier engages at the outer periphery.

10. A pump assembly according to claim 9, wherein the peripheral wall on an outer periphery is designed in a centered manner with respect to a middle axis of the can, wherein the outer periphery of the peripheral wall is machined in a material-removing manner, for centering.

11. A pump assembly according to claim 9, wherein the collar ring on an inner periphery comprises a radially inwardly directed clamping projection which bears on the can in a clamping manner.

12. A pump assembly according to claim 1, wherein a contact region, with which the bearing carrier bears on the can, is distanced in an axial direction to the centering surface on the bearing carrier.

13. A pump assembly according to claim 1, wherein the bearing carrier comprises an axially extending collar ring which in at least one section has a cross section which is shaped in an s-shape.

14. A pump assembly according to claim 13, wherein the collar ring at a free end comprises an axial surface extending transversely to a middle axis of the can.

15. A pump assembly according to claim 1, wherein an end-side surface of the bearing carrier comprises a surface section which is toroidally convexly curved towards the pump housing.

16. A pump assembly according to claim 15, wherein the end-side surface on an outer periphery comprise an annular surface section which extends transversely to a middle axis of the can and on which the curved surface section connects in a radial inwardly lying manner.

17. A pump assembly according to claim 15, wherein the curved surface section comprises an apex region, the apex region being an annular, plane apex region.

18. A pump assembly according to claim 15, wherein an apex region of the curved surface section covers a spiral channel in the pump housing, at least in a pressure-side section.

19. A pump assembly according to claim 15, wherein a region of the curved surface section which lies radially outside an apex has a smaller gradient than a region of the curved surface section which is situated radially inwardly of the apex.

20. A pump assembly according to claim 9, wherein the collar ring on an inner periphery comprises a radially inwardly directed clamping projection which bears on the can in a clamping manner and said radially inwardly directed clamping projection is formed by at least one radially inwardly directed bend-out of the collar ring.

21. A pump assembly according to claim 1, wherein said at least one radial outwardly directed bend-out comprises an apex region, said centering surface being located in said apex region, said apex region being in direct contact with said contact surface of said pump housing, said bearing carrier comprising a can contacting portion being located radially inward of said radial outwardly directed bend-out, said can contacting portion being located at a spaced location from said pump housing, said can comprising a peripheral wall, said can contacting portion comprising a can contacting surface, said can contacting surface being in direct contact with at least a portion of said peripheral wall.

* * * * *